United States Patent [19]

Curry

[11] Patent Number: 4,890,442

[45] Date of Patent: Jan. 2, 1990

[54] COLLAPSIBLE EASEL AND A METHOD FOR PACKING COLLAPSIBLE EASEL

[75] Inventor: Stephen A. Curry, Edina, Minn.

[73] Assignee: Curry Sales, Inc., Minneapolis, Minn.

[21] Appl. No.: 191,040

[22] Filed: May 6, 1988

[51] Int. Cl.[4] ..... B65B 25/00

[52] U.S. Cl. ..... 53/474

[58] Field of Search ..... 53/474, 445, 472, 428, 53/467

[56] References Cited

U.S. PATENT DOCUMENTS 3,992,849 11/1976 Lett, III ..... 53/474 X 4,390,081 6/1983 Olmsted ..... 53/474 X

*Primary Examiner*—Horace M. Culver

*Attorney, Agent, or Firm*—Merchant, Gould, Smith, Edell, Welter, & Schmidt

[57] ABSTRACT

A collapsible easel and a method for packing the easel in a box. The easel includes two leg pairs, located in a spaced parallel relationship by a planar member attached to one leg of each leg pair. The planar member has a writing surface for receiving ink from dry erase markers or the like. The legs of the easel have two members joined in collinear end-to-end abutting fashion. A tray for receiving writing instruments, erasers or the like is disposed between the leg pairs. The invention further includes a method for packaging the components of the easel in a box in a compact manner.

5 Claims, 2 Drawing Sheets

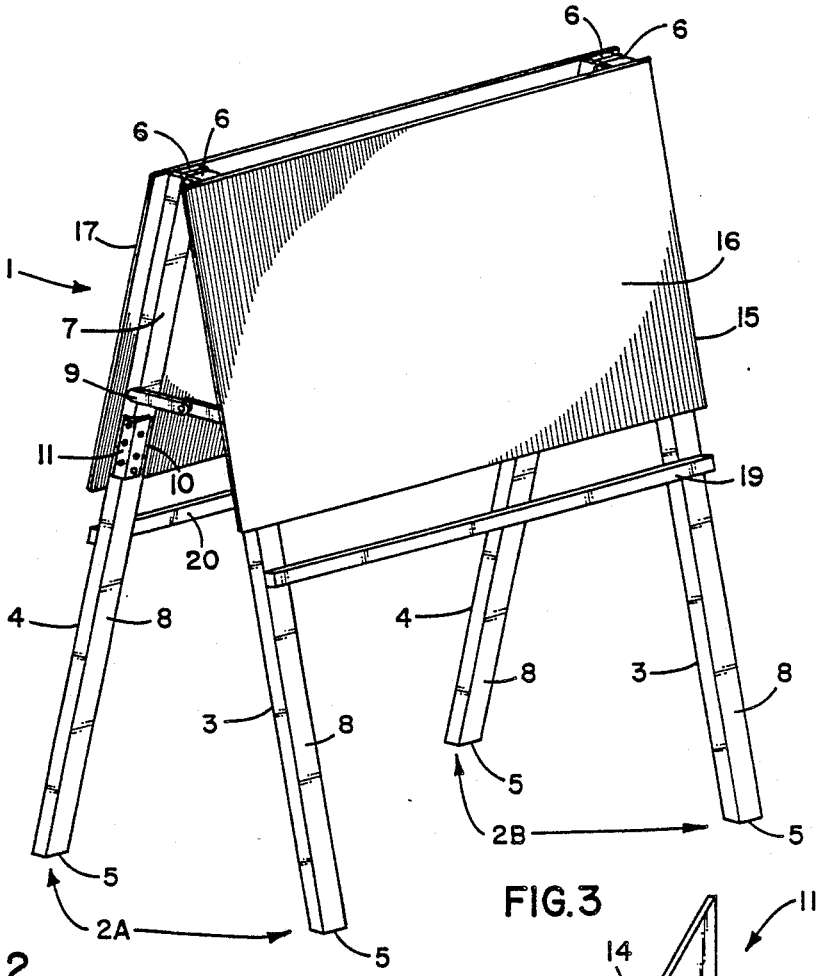
FIG.2
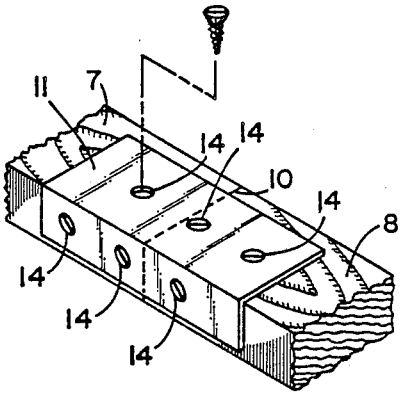
FIG.3
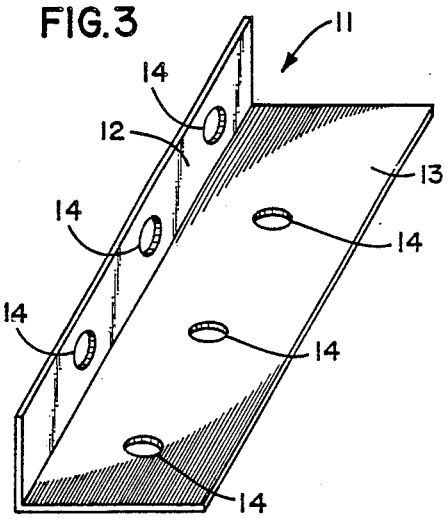

COLLAPSIBLE EASEL AND A METHOD FOR PACKING COLLAPSIBLE EASEL

TECHNICAL FIELD

The present invention relates generally to the field of portable writing surfaces, and in particular to a collapsible easel and a method for packing the easel in a compact manner.

BACKGROUND OF THE INVENTION

The present invention has significant advantages over available easels in that it can be easily disassembled and conveniently packaged in a box of a size suitable for storage, transportation and store display.

Prior devices typically included three or four single piece legs which were bulky and overly large for easy storage. This problem was minimized somewhat by the use of three legs held together by a bolt at one end which allowed the tripod forward by the legs to be collapsed somewhat. These devices where somewhat unstable when in use and were not typically capable of being stored in a small space due to their length. Affixment of a tray to hold writing implements was also difficult because the three legs needed to be moveable so as to be parallel and in contact with each other for storage.

The common four leg models were even more cumbersome due to the typical use of single piece legs. If these devices were collapsible at all, they were still so large that compact storage was almost impossible. The lack of a suitable compact storage function for the prior devices was a drawback for easy use of the devices and was even more problematic for shipping and sale of the product. Easels with single piece legs have proven so difficult to store, handle and display for sale, that many retailers have simply decoded against carrying easels at all. There is consequently a need for an improved device.

SUMMARY OF THE INVENTION

The invention is a collapsible easel having two pairs of legs, at least one planar member having a writing surface, and at least one tray. Each pair of legs is hingeably connected for movement between an open position and a closed position. The easel includes a means for limiting the range of leg movement. Each leg includes a longer leg member and a shorter leg member joined in end-to-end abutting fashion.

A planar member having a writing surface is removeably affixed to the upper portion of one leg of each leg pair opposite the ground engaging end and spans the distance between the leg pairs, thereby locating the first and second leg pairs in parallel spaced relationship. The writing surface may be a marker board, chalk board, or the like. A corkboard or other surface on which papers may be attached is also possible. A tray particularly for receiving writing instruments and erasers is removably affixed to one leg of each leg pair and spans the distance between the leg pairs.

A method of nesting the components of the easel in a box of a size and shape convenient for storage, transportation and store display is also disclosed herein. The preferred embodiment includes a rigid joining plate for joining the leg members in end-to-end abutting fashion. An optional embodiment further includes a second planar member having a writing surface removeably affixed to a second leg of each leg pair near the end of the leg opposite the ground engaging leg and spanning the distance between leg pairs. An alternate embodiment further includes a second tray removeably affixed to a second leg of each leg pair; and spanning the distance between leg pairs.

BRIEF DESCRIPTION OF THE DRAWINGS

FIG. 1 is a perspective view of the preferred embodiment in an open, self-supporting position.

FIG. 2 is a perspective view of the joining means holding leg pieces in end-to-end abutting fashion.

FIG. 3 is a perspective view of the joining means in the preferred embodiment.

DETAILED DESCRIPTION OF THE INVENTION

Figure 4:
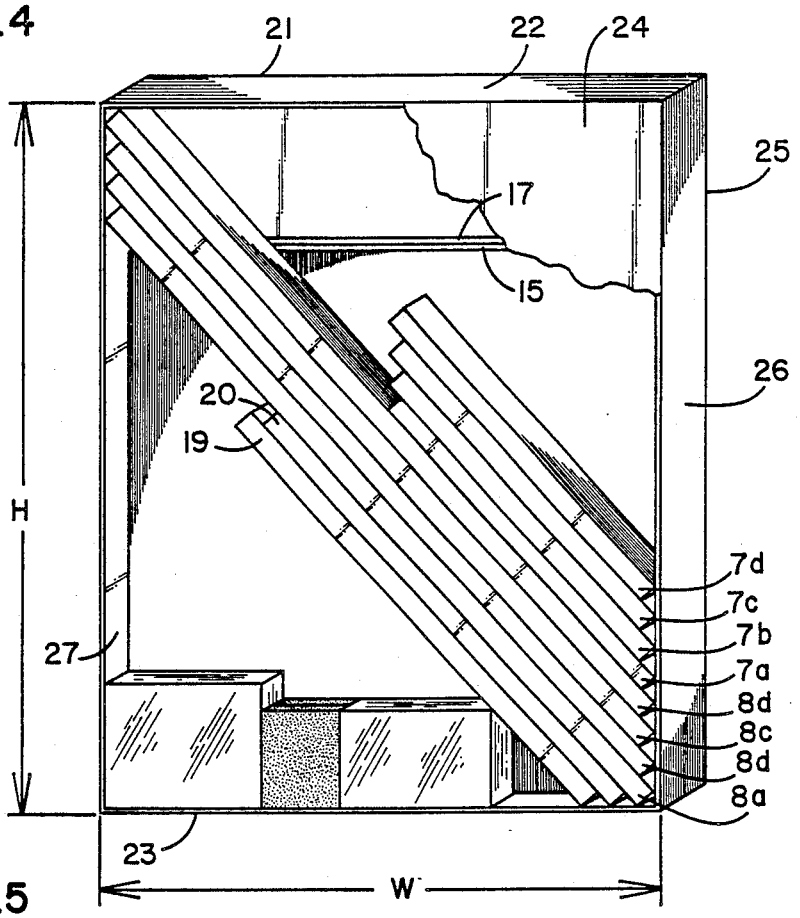
FIG. 4 is a perspective view of the easel components nested in the storage box.

Throughout the following description reference will be made to the drawings and the same numerals will be used throughout the several views to indicate the same or like parts of the invention.

As shown in FIG. 1, the easel (1) has two leg pairs, (2A and 2B), each leg pair having a first leg (3) and a second leg (4). Each leg has a ground engaging end (5) and an opposite upper end (6). The opposite upper ends (6) of the first leg (3) and the second leg (4) in each leg pair, are hingeably connected. The hinged connection allows movement of the legs (3, 4) from a closed position where the ground engaging ends (5) of the legs (3, 4) are close together and an open position where the ground engaging ends (5) of the legs (3, 4) are spaced apart.

A limiting means (9) restricts movement of the hinged legs (3, 4) and allows the easel to be self-supporting when legs (3, 4) are in the open position.

Each leg (3, 4) has a shorter leg member (7) and a longer leg member (8) joined in end-to-end abutting fashion at a point of abutment (10). In the embodiment of FIGS. 1, 2 and 3, a rigid joining plate (11), engages adjacent perpendicular surfaces of two leg members. The plate (11) has two leg engaging surfaces (12, 13) lying in two intersecting planes. Each surface has three holes (14) for receiving screws or the like to secure the plate (11) to the leg members (7, 8). The holes (14) are in a spaced relationship such that three holes lie on each side of the point of abutment (10).

Removeably affixed to the first leg (3) of each leg pair (2A, 2B) and spanning the distance between the leg pairs (2A, 2B) is a first planar member (15) having a first writing surface (16). The writing surface (16) may be for receiving ink from dry erase markers or for receiving chalk. In the embodiment shown in FIG. 1, a second planar member (17) having a second writing surface (not shown) is removeably affixed to the second leg (4) of each leg pair (2A, 2B) and spans the distance between the leg pairs (2A, 2B).

A first tray (19) for receiving writing instruments and erasers is removeably affixed to the first legs (3) of each leg pair (2A, 2B) an spans the distance between the leg pairs (2A, 2B). In the embodiment shown in FIG. 1, tray (19) is affixed below the lower edge of the planar member (15). A second tray (20), as shown in the embodiment in FIG. 1, may be similarly affixed to second legs (4) of each leg pair (2A, 2B) and spanning the distance between leg pairs (2A, 2B).

This invention further includes a method of packaging a disassembled easel in a box (21) of a particularly convenient size as shown in FIG. 4. The box (21) has a planar top (22), bottom (23), front (24), back (25), a first side (26) and a second side (27). The top (22) and bottom (23) are parallel and spaced apart. The front (24) and back (25) are parallel and spaced apart. The sides (27, 27) are parallel and spaced apart. The front (24) and back (25) and each side (26, 27) are perpendicular to and contiguous with top (22) and bottom (23).

Figure 5:
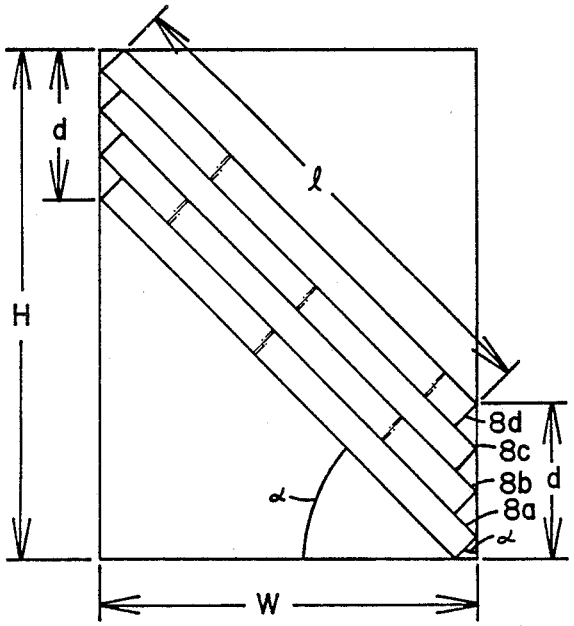
FIG. 5 is a schematic view of the longer leg members nested in the storage box.

The planar members (15, 17) are positioned in the box face-to-face with the back (25) of the box (21). The leg members (7*a, b, c, d* and 8*a, b, c, d*) are nested within the box so that they are coplanar and parallel and abut one against the other. The four longer leg members (8*a, b, c, d*) are positioned such that they extend generally diagonally from one lower corner of the box to the upper opposite corner of the box (21). This is illustrated in FIG. 4 and 5. The longer leg members (8*a, b, c, d*) do not, however, lie parallel to the diagonal formed between the lower corner and the opposite upper corner. Leg members (7*a, b, c, d* and 8*a, b, c, d*) are parallel and disposed at an angle $\alpha$ from the bottom (23) of the box (21). Angle $\alpha$ is less than the angle between the diagonal of the box and the bottom (23) of the box (21). Thus, one end of a first longer leg member (8*a*) abuts in a lower corner of box (21); the opposite end of the same leg member (8) rests against the opposite side of the box a distance (d) from the upper opposite corner of the box.

Figure 6:
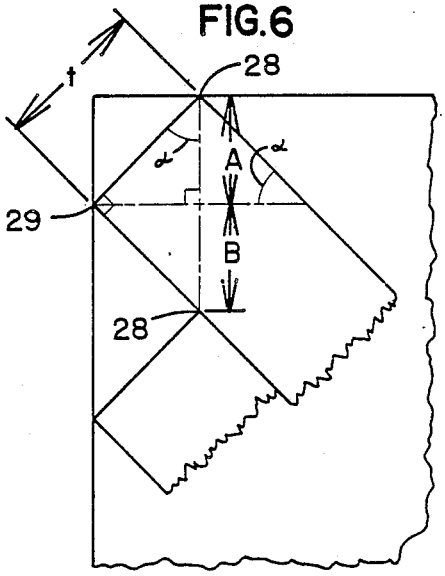
FIG. 6 is a schematic view of a single long leg member in the box.

As can be seen in FIG. 5, distance (d) equals 3(A+B-)+A, where A and B are clearly illustrated in FIG. 6. Length (A) is the vertical distance from the uppermost edge (28) of a longer leg member (8) to a horizontal line through a second edge (29) of the same leg member (8). Length (B) is the vertical distance from the uppermost edge (28) of a lower adjacent longer leg member (8) to a horizontal line through a second edge (29) of an upper longer leg member. Length (A) will not be equal to length (B) when $\alpha$ is not 45°.

Applying simple trigonometry to this configuration gives the following:

$$A = t \cos \alpha$$
$$A + B = t/\cos \alpha$$

where t is the thickness of the leg member (8). Therefore, $d=3(t/\cos\ \alpha)+t\ \cos\ \alpha$ (since, as stated, $d=3(A+B)+A$).

For the easel parts to fit securely in the box, as shown in FIGS. 4 and 5, the dimensions on the box must be proportional to the leg lengths in the following way: $H=3t/\cos\ \alpha+t\ \cos\ \alpha+l\ \sin\ \alpha$, where l is the length of a longer leg member (8); and $W=l\ \cos\ \alpha+t\ \sin\ \alpha$.

FIGS. 4 and 5 show that a second and third longer leg member (8*b, c*) are nested above and parallel to the first leg member (8*a*). These leg members abut opposite sides (26, 27) of the box (21). A fourth longer leg member (8) is nested above and parallel to first leg member (8*a*) and adjacent to longer leg member (8*c*). One end abuts the upper opposite corner and the opposite end abuts the opposite wall near the lower corner a distance (*d*) from the bottom (23) of the box (21).

The four shorter leg members (7*a, b, c, d*) lay parallel to, adjacent to and above the four longer leg members (8*a, b, c, d*).

Trays (19 and 20) are disposed parallel to, adjacent to and below first longer leg member (8*a*).

In light of the above teachings, it will be appreciated that several variations of the disclosed embodiments are possible. Those skilled in the art will no doubt be able to utilize the principles of this invention other than as specifically described above. Therefore, it is to be understood that the scope of this invention is to be limited only by the following claims.

I claim:

1. A method of packing a collapsible easel, including two leg pairs, each said leg of each said leg pair having a shorter leg member and a longer leg member, first and second planar members each having a writing surface, and a tray, within a box having a planar top and bottom and four planar sides, said top and bottom parallel and spaced apart and each side perpendicular to and contiguous with said top and said bottom, the method comprising the steps of:

(1) positioning said writing surfaces of said planar members face to face with said box;

(2) nesting the leg members together within said box so that the four longer members are coplanar and parallel, abutting one against the other generally diagonally within the box so that each of the uppermost and lowermost nested longer members has one end substantially at one corner of said box with the opposite end against a side of the box a distance generally equal to $3t/\cos\ \alpha+t\ \cos\ \alpha$ from the diagonally opposite corner, and the two other longer leg members are firmly retained within said box between said uppermost and lowermost members, wherein $\alpha$ represents the angle subtended by the longer leg members and the bottom side, and t represents the thickness of each longer leg member.

2. The method of claim 1 wherein the height of said box is: $3t/\cos\ \alpha+t\ \cos\ \alpha+l\ \sin\ \alpha$; and the width of said box is: $l\ \cos\ \alpha+t\ \sin\ \alpha$, wherein t represents the thickness of each said longer leg member, and l represents the length of each said longer leg member.

3. The method of claim 1 wherein the height of said box is 27¾" and the width of said box is 22".

4. The method of claim 1 further comprising the steps of:

(3) placing the tray within the box abutting against said upper leg members generally diagonally within said box.

5. A method of packing a collapsible easel, including two leg pairs, each leg of each said leg pair having a shorter leg member and a longer leg member, at least one planar member having a writing surface, within a box having a planar top and bottom and four planar sides, said top and bottom parallel and spaced apart and each side perpendicular to and contiguous with said top and said bottom, said method comprising the steps of:

(1) positioning said writing surface of said planar member parallel to and abutting said box;

(2) nesting the leg members together within said box so that the four longer leg members are coplanar and parallel, abutting one against the other generally diagonally within the box so that each of the uppermost and lowermost nested longer leg members has one end substantially at one corner of said box with the opposite end against a side of the box a predetermined distance from the diagonally opposite corner, and the other longer leg members are firmly retained within said box between said uppermost and lowermost members.

* * * * *

UNITED STATES PATENT AND TRADEMARK OFFICE

CERTIFICATE OF CORRECTION

PATENT NO. : 4,890,442

DATED : 1-2-90

INVENTOR(S) : Stephen A. Curry

It is certified that error appears in the above-identified patent and that said Letters Patent is hereby corrected as shown below:

Col.1, line 21
"where" should be --were--

Col.1, line 37
"decoded" should be --decided--

Col.3, line 10
"27" should be --26--

Col.3, lines 55 & 56
Col,4, lines 37, 38 & 39
"1" should be --1--

Signed and Sealed this

Eighth Day of January, 1991

*Attest:*

*Attesting Officer*

HARRY F. MANBECK, JR.

*Commissioner of Patents and Trademarks*